US006454636B1

(12) United States Patent
Iwabuchi

(10) Patent No.: US 6,454,636 B1
(45) Date of Patent: Sep. 24, 2002

(54) METHOD AND APPARATUS FOR SUPPLYING COOLANT IN A GRINDING MACHINE

(75) Inventor: Hideo Iwabuchi, Abiko (JP)

(73) Assignee: Hitachi Seiki Co., Ltd., Abiko (JP)

( * ) Notice: Subject to any disclaimer, the term of this patent is extended or adjusted under 35 U.S.C. 154(b) by 23 days.

(21) Appl. No.: 09/597,252

(22) Filed: Jun. 19, 2000

(30) Foreign Application Priority Data

Jun. 22, 1999 (JP) ..... 11-176124

(51) Int. Cl.[7] ..... B24B 55/02
(52) U.S. Cl. ..... 451/53; 451/450; 451/488
(58) Field of Search ..... 451/53, 72, 444, 451/450, 488; 125/11.22

(56) References Cited

U.S. PATENT DOCUMENTS

| | | | | |
|---|---|---|---|---|
| 1,832,104 A | * 11/1931 | Drake | ..... | 451/450 |
| 4,619,078 A | 10/1986 | Uhlig | | |
| 4,822,218 A | 4/1989 | Satoh | | |
| 4,929,130 A | 5/1990 | Diebolt et al. | | |

FOREIGN PATENT DOCUMENTS

| | | | | |
|---|---|---|---|---|
| DE | 0701220 | * 1/1941 | ..... | 451/450 |
| JP | 347018834 | * 5/1972 | ..... | 451/450 |
| JP | 61-241065 | 10/1986 | | |
| JP | 363052969 | * 3/1988 | ..... | 451/450 |
| JP | 6-312366 | 11/1994 | | |

* cited by examiner

*Primary Examiner*—Robert A. Rose
(74) *Attorney, Agent, or Firm*—Armstrong, Westerman & Hattori, LLP

(57) ABSTRACT

In a method and an apparatus for supplying coolant in a grinding machine while the grinding machine grinds, a cooling nozzle and a cleaning nozzle are mounted on a moving member, and the moving member is moved in a direction identical with a first normal line, relative to the grinding wheel, at a first predetermined angle away from a reference straight line perpendicular to an axis of a main spindle. The reference straight line passes through a grinding point. Accordingly, the cooling nozzle injects the coolant with an injecting outlet port directed in a direction of a tangential line, of the grinding wheel, passing through the grinding point. The cleaning nozzle injects the coolant with an injecting outlet port directed in a direction of a normal line relative to the grinding wheel.

12 Claims, 8 Drawing Sheets

METHOD AND APPARATUS FOR SUPPLYING COOLANT IN A GRINDING MACHINE

BACKGROUND OF THE INVENTION

1. Field of the Invention

The present invention relates to a method and an apparatus for supplying coolant in the grinding machine, while a grinding machine grinds, for grinding a workpiece by rotating a grinding wheel, and more particularly to the method and the apparatus for supplying the coolant while the grinding machine performs a creep feed grinding.

2. Description of the Related Art

In the grinding machine, a main spindle is rotated for grinding a workpiece with a grinding wheel under the condition that the grinding wheel is mounted on the main spindle movable relative to the workpiece. A coolant supply apparatus for supplying coolant (cutting fluid, grinding fluid, and the like) is provided in the grinding machine.

The coolant supply apparatus injects the coolant for cooling a grinding point at which the grinding wheel grinds the workpiece, and the coolant cools down the vicinity of the grinding point to thereby prevent a heat generation while the grinding machine grinds.

It is ideal that the coolant is injected in a tangential direction at the grinding point. However, unlike another tool in other machine tools, a diameter of the grinding wheel for grinding the workpiece is gradually decreased by wearing and dressing of the grinding wheel as the working for grinding the workpiece is advanced.

Accordingly, when a nozzle is mounted on a cover of a grinding wheel and the coolant for cooling the grinding point is injected in a direction of a tangential line of the grinding wheel as in a surface grinding machine, the coolant does not come to impinge against the grinding wheel as the diameter of the grinding wheel is gradually decreased.

Accordingly, there is a conventional technical approach that a nozzle is provided in advance at a predetermined position in a direction slightly slanted relative to the tangential line and the coolant is injected by the nozzle to cool only the vicinity of the grinding point.

Also, in order to prevent the loading chips on the grinding wheel, it is preferable that the coolant for cleaning is injected on a periphery of the grinding wheel. Therefore, there is also a technical approach that the coolant is injected onto a periphery at an intermediate portion between the grinding point and the cleaning position of the grinding wheel so that a cooling operation of the grinding point and a cleaning operation of the grinding wheel may be simultaneously performed by a single nozzle.

By the way, in order to stably grind, it is one of the important factors to always sufficiently supply the coolant at least to the grinding point without failure while the grinding wheel grinds.

While the grinding machine performs the creep feed grinding, a cutting amount of the grinding wheel to the workpiece is increased and the grinding wheel is moved at a low speed to grind a profile of the workpiece, and the like. In particular, in the case in which the creep feed grinding is carried out, in comparison with a traverse grinding or the like it is important to sufficiently supply the coolant without failure while the grinding machine grinds.

However, in case of the above-described prior art for cooling down only the vicinity of the grinding point, since it is impossible to prevent the loading chips on the grinding wheel, there is a fear that it comes to be difficult to perform the creep feed grinding. Namely, a grinding burn occurs on a surface, to be ground, of the workpiece and a grinding force is increased, disadvantageously.

Also in case of the above-described prior art for simultaneously performing the cooling operation of the grinding point and the cleaning operation of the grinding wheel with the single nozzle, there is a tendency that the cooling of the grinding point with the coolant gets to be insufficient. It is preferable that the coolant for cleaning is injected in a direction (i.e., normal line direction) perpendicular to the periphery (grinding circumferential surface) of the grinding wheel.

However, in case of the above-described prior art, there is a fear that an injecting direction of the coolant for cleaning is remarkably shifted from the normal line relative to the periphery of the grinding wheel and as a result a cleaning effect of the coolant gets to be degraded. Namely, also in this prior art, it is impossible to prevent the grinding burn and the increasing of the grinding force.

In another piece of the prior art, a nozzle is provided on a tip end of an arm of a robot fixed to a machine body and the arm is moved in a desired direction to supply the coolant. However, in this case, a movable range of the arm is restricted. For this reason, depending upon the relationship a shape of the workpiece to the grinding point positioned between the grinding wheel and the workpiece, the arm cannot reach the vicinity of the grinding point thereby to be unable to inject the coolant without failure.

Thus, if the sufficient amount of coolant were not supplied to the periphery of the grinding wheel and the grinding point, the grinding comes to be instable and the damage of the grinding wheel occurs and it becomes to be difficult to favorably grind the workpiece.

SUMMARY OF THE INVENTION

In order to overcome the above-noted defects, an object of the present invention is to provide a method and an apparatus for supplying coolant in a grinding machine in which, even if a diameter of a grinding wheel of the grinding machine is changed, the coolant is always injected along a tangential line of the grinding wheel to a grinding point at which the grinding wheel grinds a workpiece and is always injected, substantially in a direction perpendicular to a periphery of the grinding wheel, to the periphery away from the grinding point to thereby make it possible to continuously and stably grind.

Another object of the present invention is to provide a method and an apparatus for supplying coolant in a grinding machine in which, even if the diameter of the grinding wheel of the grinding machine is changed, the coolant is injected to the grinding point along the tangential line on both sides of the grinding wheel to thereby make it possible to continuously and stably grind.

In order to attain these and other objects, according to the present invention, there is provided a method for supplying coolant in a grinding machine, while the grinding machine grinds, which grinds a workpiece by rotating a grinding wheel mounted on a main spindle and by relatively moving the workpiece and the grinding wheel along at least three mutually transverse axes including a direction parallel with an axis of the main spindle, the method comprising the following steps of: mounting on a moving member at least one first nozzle, for cooling a grinding point at which the grinding wheel grinds the workpiece, and at least one second nozzle for cleaning a periphery of the grinding wheel; and moving the moving member in a direction substantially identical with a first normal line, relative to the grinding wheel, which is positioned at a first predetermined angle away from a reference straight line passing through the grinding point and being perpendicular to the axis of the main spindle, whereby the first nozzle injects the coolant with an injecting outlet port directed in a direction substantially identical with a tangential line, of the grinding wheel, passing through the grinding point, and the second nozzle injects the coolant with an injecting outlet port directed in a direction substantially identical with a normal line relative to the grinding wheel.

It is preferable that the moving member is movable in correspondence with a changing diameter of the grinding wheel, and while the diameter of the grinding wheel is changing, the injecting outlet port of the first nozzle is always directed in the direction substantially identical with the tangential line, of the grinding wheel, passing through the grinding point, and the injecting outlet port of the second nozzle is always directed in the direction substantially identical with the normal line relative to the grinding wheel.

Preferably, the moving member is movable in a direction parallel with the axis of the main spindle. The moving member swivels round the axis of the main spindle.

It is preferable that the first nozzle and the second nozzle are mounted on a single supporting member which is detachably mounted on the moving member.

Preferably, the supporting member is possible to be changed for another supporting member, at least one first nozzle and at least one second nozzle are respectively mounted on the last-mentioned other supporting member at counter positions to the mounting positions of the first nozzle and the second nozzle on the first-mentioned supporting member, and the other supporting member is detachably mounted on the moving member.

Also, it is preferable that, after the moving member is operatively swivelled round the axis of the main spindle so that the moving member is moved to a position of a second normal line, relative to the grinding wheel, which is opposite to the position of the first normal line relative to the reference straight line and is positioned at a second predetermined angle away from the reference straight line, the moving member is moved in a direction substantially identical with the second normal line, whereby the first nozzle in the counter position injects the coolant with an injecting outlet port directed in a direction substantially identical with a tangential line, of the grinding wheel, passing through the grinding point, and the second nozzle in the counter position injects the coolant with an injecting outlet port directed in a direction substantially identical with a normal line relative to the grinding wheel.

Preferably, the first predetermined angle is selected from a range of 15 to 50 degrees.

It is preferable that the coolant having a. predetermined pressure at a predetermined flow rate is supplied to the first nozzle for cooling the grinding point, and the coolant having a higher pressure than the predetermined pressure is supplied for cleaning to the second nozzle at a smaller flow rate than the predetermined flow rate.

It is preferable that the moving member makes a motion for always maintaining the same posture along a predetermined plain including the axis of the main spindle.

Preferably, the grinding machine comprises a dresser supporting member which rotatably supports at least one dresser for dressing the grinding wheel, the dresser supporting member is relatively movable to the main spindle in at least one direction perpendicular to the axis of the main spindle, wherein the grinding machine is able to grind with continuous dressing in which an operation of dressing the grinding wheel with the dresser and an operation of grinding the workpiece with the grinding wheel are simultaneously performed, wherein the coolant is injected in the direction substantially identical with the tangential line while the grinding machine grinds with continuous dressing, and the coolant is injected in the direction substantially identical with the normal line while the grinding machine grinds with continuous dressing.

In order to attain the above described objects, according to the present invention, there is provided an apparatus for supplying coolant in a grinding machine which grinds a workpiece by rotating a grinding wheel mounted on a main spindle and by relatively moving the workpiece and the grinding wheel along at least three mutually transverse axes including a direction parallel with an axis of the main spindle, the apparatus comprising: a moving member provided on a spindle head for rotatably supporting the main spindle, the moving member being movable in a plain perpendicular to at least the axis of the main spindle relative to the grinding wheel; at least one first nozzle provided on the moving member with an injecting outlet port directed in a direction substantially identical with a tangential line, of the grinding wheel, passing through a grinding point, for cooling the grinding point at which the grinding wheel grinds the workpiece; at least one second nozzle provided on the moving member with an injecting outlet port directed in a direction substantially identical with a normal line relative to the grinding wheel, for cleaning a periphery of the grinding wheel; and a nozzle moving controller for controlling the movement of the moving member in a direction substantially identical with a first normal line, relative to the grinding wheel, which is positioned at a first predetermined angle away from a reference straight line passing through the grinding point, the reference straight line being perpendicular to the axis of the main spindle.

Preferably, a nozzle supporting device having the moving member is mounted on the spindle head, and the nozzle supporting device has a mechanism for moving the moving member in a direction parallel with the axis of the main spindle. The mechanism for moving the moving member in a direction parallel with the axis of the main spindle comprises an arm swinging mechanism and a parallel link mechanism, and the moving member makes a motion for always maintaining the same posture along a predetermined plain including the axis of the main spindle.

It is preferable that a swiveling sleeve is fitted around the spindle head to be able to swivel round the main spindle so as to center the axis of the main spindle, and a nozzle supporting device having the moving member is mounted on the swiveling sleeve, wherein, when a driving motor is driven so that the swiveling sleeve makes a swiveling motion, the moving member is swivelled round the main spindle so as to center the axis of the main spindle.

In another embodiment, there is provided an apparatus for supplying coolant in a grinding machine which grinds a workpiece by rotating a grinding wheel mounted on a main spindle and by relatively moving the workpiece and the grinding wheel along at least three mutually transverse axes including a direction parallel with an axis of the main spindle, a dresser supporting member for rotatably supporting at least one dresser for dressing the grinding wheel being moved relative to the main spindle in at least one direction perpendicular to the axis of the main spindle, the apparatus comprising: at least one cooling nozzle provided for cooling a grinding point at which the grinding wheel grinds the workpiece, the cooling nozzle injecting the coolant with an injecting outlet port always directed in a direction substantially identical with a tangential line, of the grinding wheel, passing through the grinding point; a moving unit for moving in an opposite direction to a moving direction of the dresser supporting member and for moving with the same moving amount as that of the dresser supporting member; and at least one auxiliary cooling nozzle for cooling the grinding point with an assistance, the auxiliary cooling nozzle being provided on the moving unit and being located at a position facing the cooling nozzle, wherein an injecting outlet port of the auxiliary cooling nozzle is always directed in the direction substantially identical with the tangential line, of the grinding wheel, passing through the grinding point, and injects the coolant to the grinding point from a substantially opposite direction to the cooling nozzle.

Preferably, the apparatus for supplying coolant further comprising a cleaning nozzle, wherein an injecting outlet port of the cleaning nozzle is always directed in the direction substantially identical with the normal line of the grinding wheel, so that the injecting outlet port of the cleaning nozzle injects the coolant to a periphery of the grinding wheel.

With the above-described structure according to the present invention, even if the diameter of the grinding wheel of the grinding machine is changed, a sufficient amount coolant is injected at least to the grinding point without failure to thereby continuously and stably grind. Namely, there is no fear of the grinding burn of the workpiece and is no fear of the increasing of the grinding force. Also, it is possible to prolong a tool life of the grinding wheel.

BRIEF DESCRIPTION OF THE DRAWINGS

In the accompanying drawings:

FIGS. 1 to 6A and FIG. 6B are views showing a first embodiment of the present invention;

FIG. 1 is a perspective view showing a grinding machine;

FIG. 2 is a right side view showing a schematic structure of a primary part of the grinding machine;

FIG. 3 is a schematic structural view showing a coolant supply apparatus mounted on the grinding machine;

FIG. 5 is a schematic structural view showing a condition that a coolant is supplied;

FIG. 6A is a view taken along a line VI of FIG. 5 and shows a clamping condition;

FIG. 6B is a view taken along the line VI of FIG. 5 and shows an unclamping condition;

FIG. 7 is a left side view showing a schematic structure of a grinding machine;

FIG. 8 is an enlarged view as viewed in a direction VIII of FIG. 7; and

FIG. 9 is a view as viewed in a direction IX—IX of FIG. 7.

DESCRIPTION OF THE PREFERRED EMBODIMENTS

Embodiments of the present invention will now be described with reference to FIGS. 1 to 9.

First Embodiment

Figure 1:
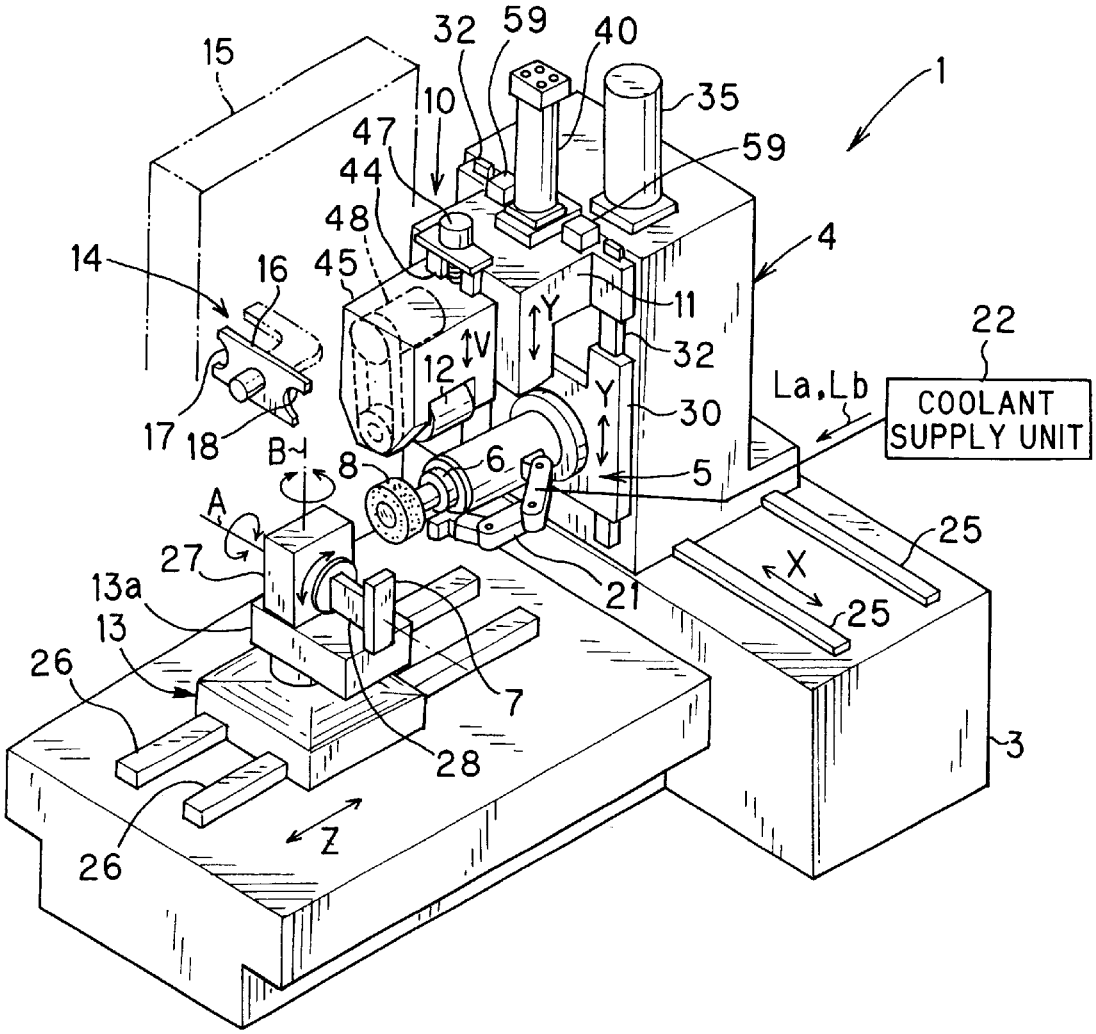
Figure 2:
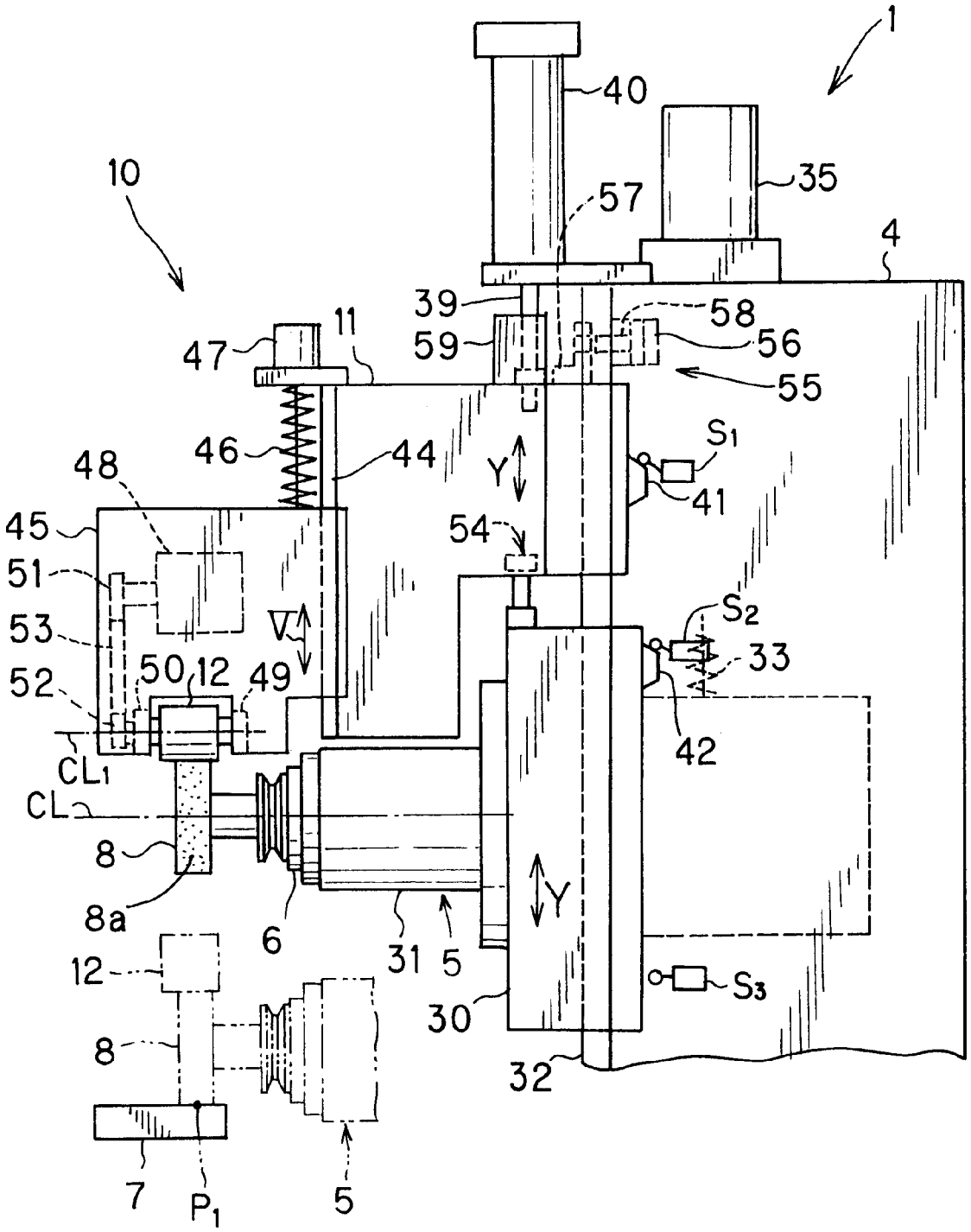
Figure 3:
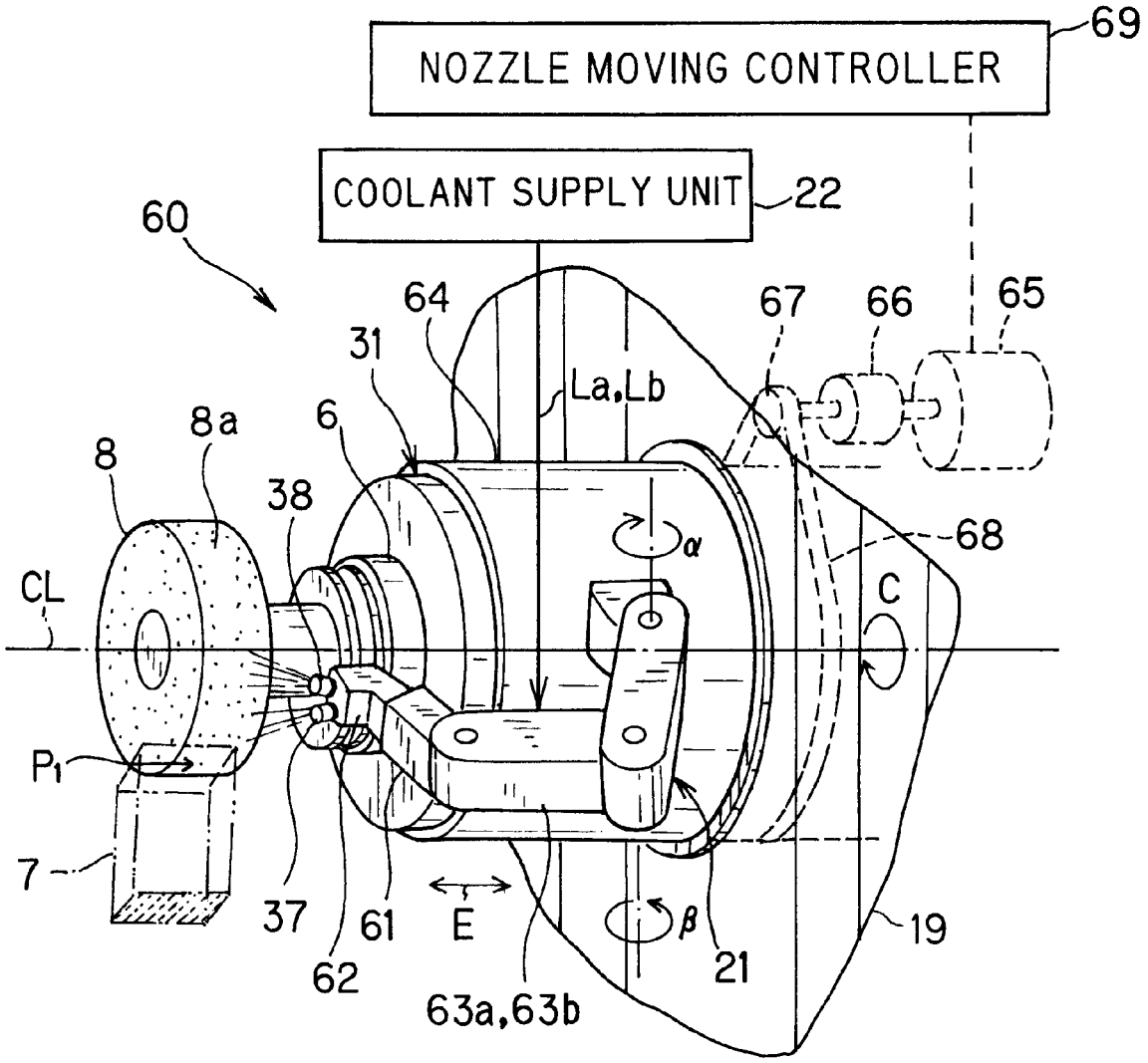
Figure 4A:
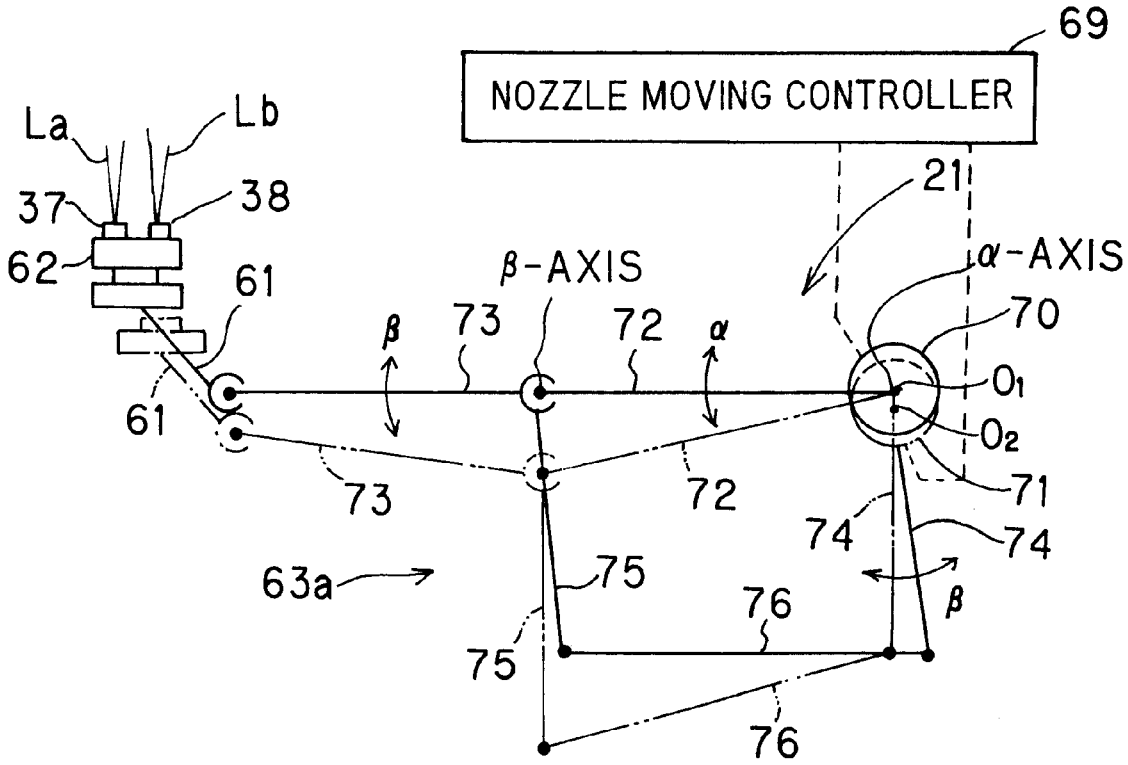
FIG. 4A is a schematic structural view showing a link mechanism of a nozzle supporting device.
Figure 4B:
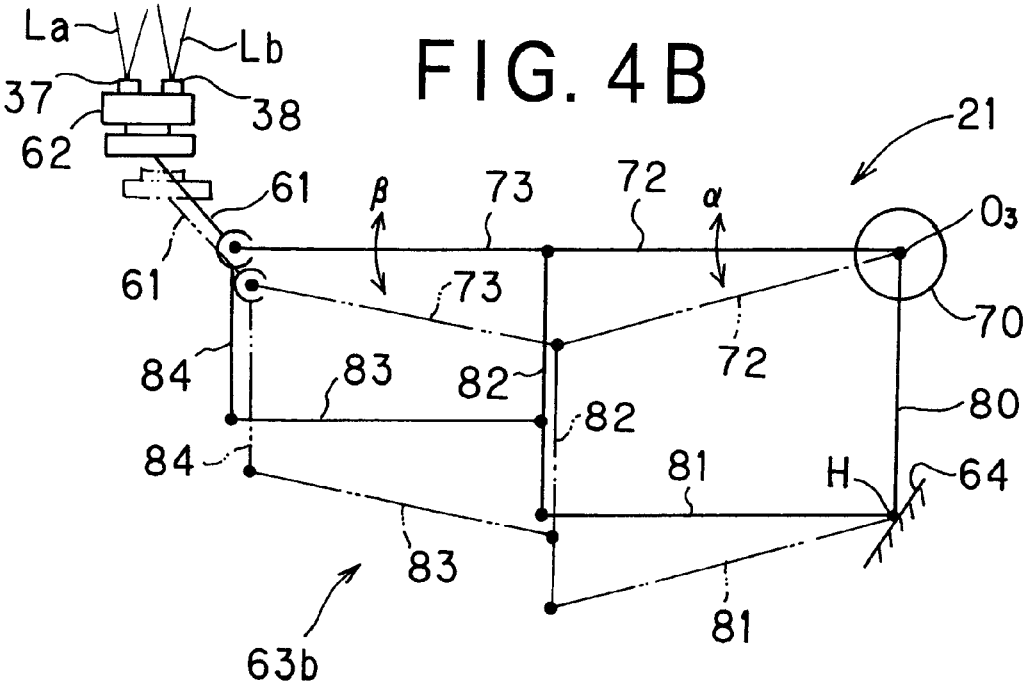
FIG. 4B is a schematic structural view showing an operation of the nozzle supporting device.
Figure 5:
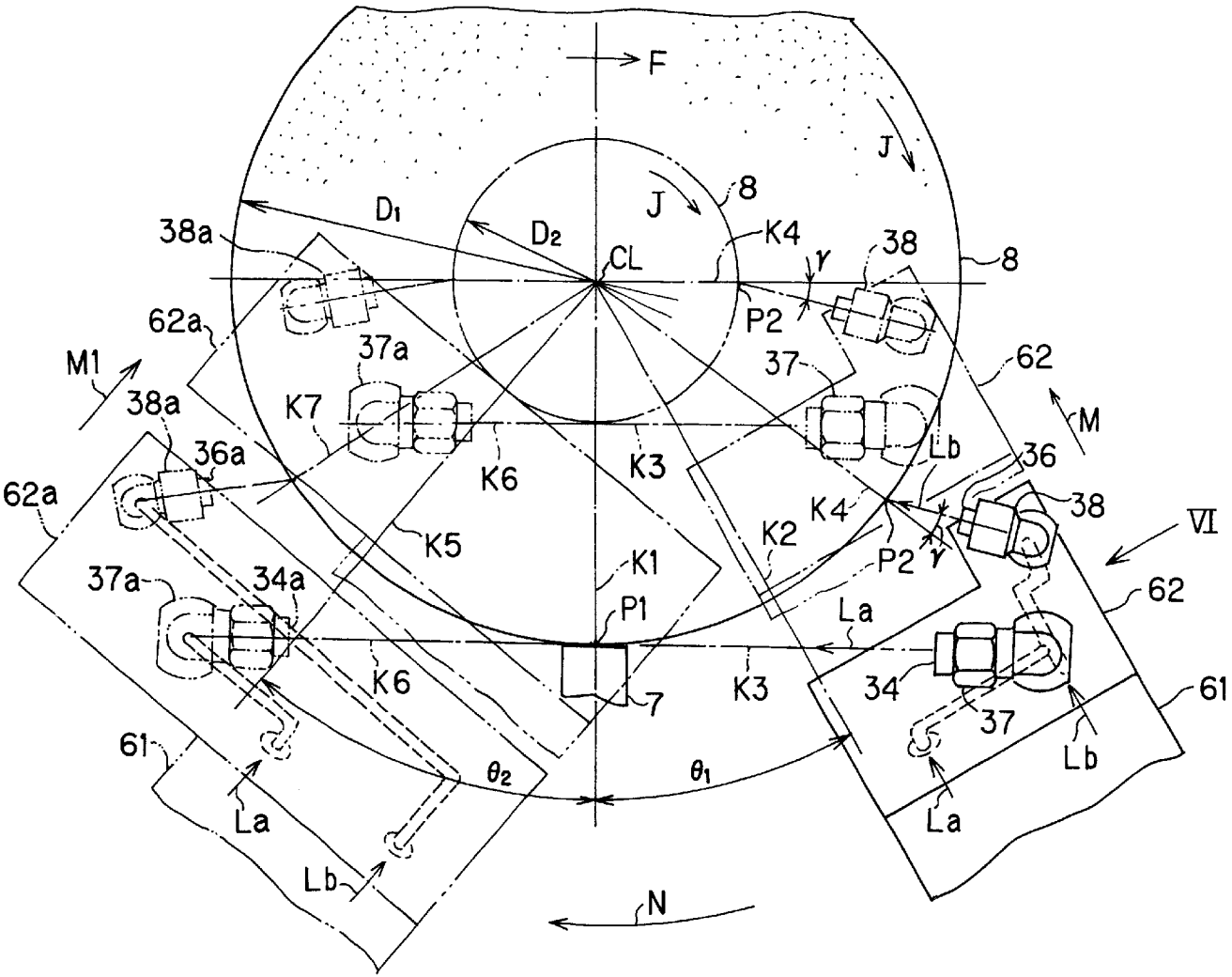
Figure 6A:
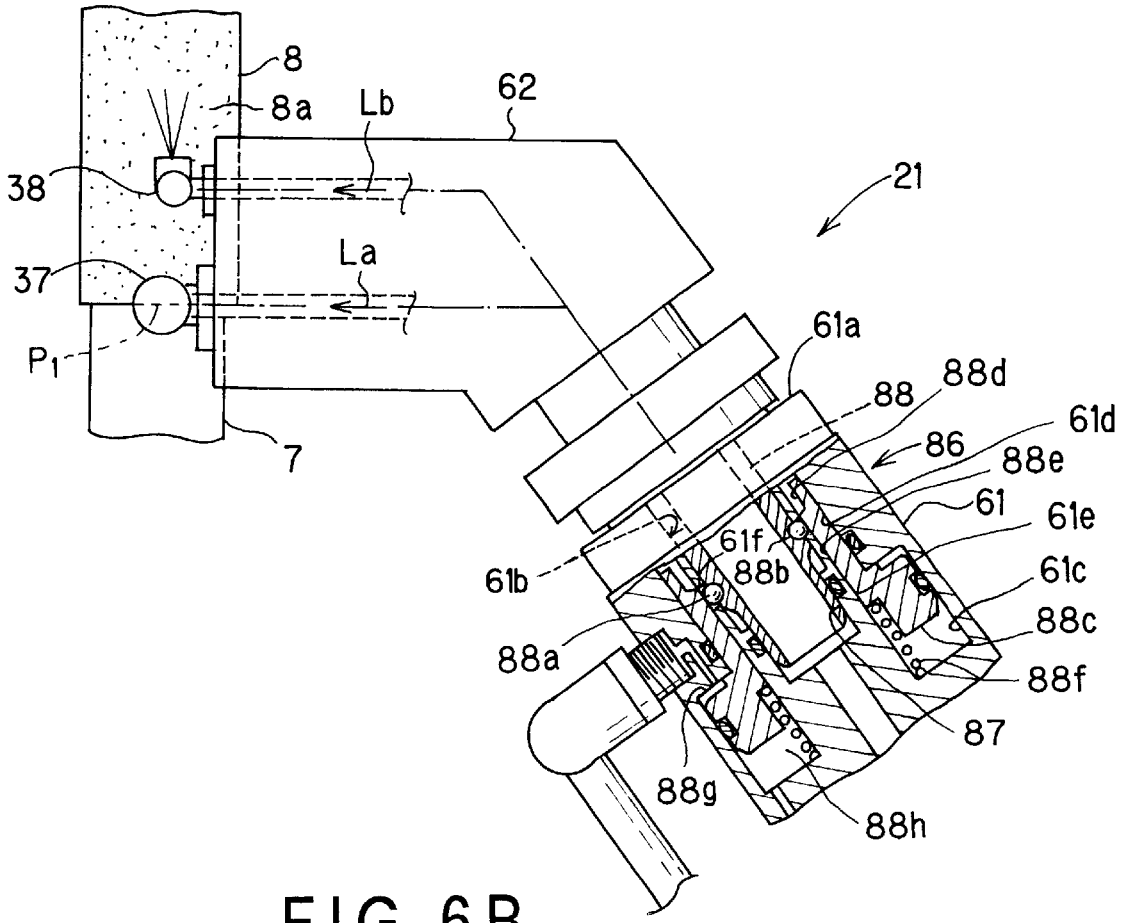
Figure 6B:
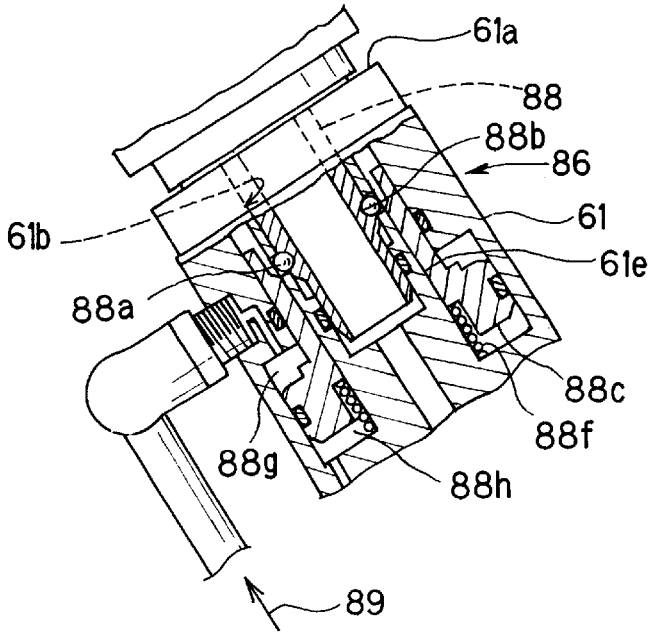

FIGS. 1 to 6A and FIG. 6B are views showing a first embodiment of the present invention, FIG. 1 is a perspective view of a grinding machine, FIG. 2 is a right side view showing a schematic structure of a primary part of the grinding machine, FIG. 3 is a schematic structural view showing a coolant supply apparatus mounted on the grinding machine, FIG. 4A is a schematic structural view showing a link mechanism of a nozzle supporting device, FIG. 4B is a schematic structural view showing an operation thereof, FIG. 5 is a schematic structural view showing a condition that coolant is supplied, and FIGS. 6A and 6B are views taken along a line VI of FIG. 5.

The grinding machine will first be described. As shown in FIGS. 1 and 2, in the grinding machine 1, a column 4 is provided on a bed 3 to be movable in a horizontal direction, and a spindle head 5 is provided on the column 4 to be movable in a vertical direction.

A main spindle 6 is rotatably supported to the spindle head 5. The main spindle 6 is drivingly rotated by a main spindle motor (not shown). A grinding wheel 8 to be used as a tool for grinding a workpiece 7 is detachably mounted at a front end portion of the main spindle 6.

A well known tool clamping and unclamping mechanism which detachably mounts, on a spindle nose, a tool (i.e. grinding wheel), such as a tool having a BT tool shank (7/24 Taper tool shank) and a two surface restricted tool such as an HSK (Hohl Schaft Kegel) tool, is provided on the main spindle 6. The grinding wheel 8 is clamped to or unclamped from the main spindle 6 by the tool clamping and unclamping mechanism.

Incidentally, it is assumed that a Z-axis direction is a direction parallel with an axis of the main spindle 6, and an X-axis direction (an axis in the horizontal direction) and a Y-axis direction (an axis in the vertical direction) are axis directions for intersecting to the Z-axis respectively and for constituting a perpendicular coordinate system.

A pair of parallel guide rails (for an X-axis guideway) 25 are provided in the X-axis direction on a top surface of the bed 3. The column 4 is disposed to be movable in the X-axis direction along the two guide rails 25. The X-axis guideway for guiding the column 4 may be selected from a rolling guide, a plain bearing guideway, and the like.

The column 4 is moved to-and-fro in the X-axis direction on the bed 3 by an X-axis servomotor through an X-axis ball screw (not shown).

The spindle head 5 is composed of a head body portion 30 supported movably to the column 4 and a nose portion 31 projecting in the Z-axis direction from the head body portion 30. A pair of guide rails (for a Y-axis guideway) 32 which are parallel with each other are provided in the Y-axis direction on the column 4. The head body portion 30 is moved in the Y-axis direction by a guidance of the guide rails 32. The Y-axis guideway for guiding the spindle head 5 may be selected from a rolling guide, a plain bearing guideway, and the like.

A screw shaft 33 of a Y-axis ball screw is disposed in the Y-axis direction parallel with the guide rails 32. A nut (not shown) fixed to the head body portion 30 is screwed on the screw shaft 33.

The screw shaft 33 is drivingly rotated in forward and backward directions by a Y-axis servomotor 35 mounted on a top portion of the column 4. When the screw shaft 33 is drivingly rotated by the Y-axis servomotor 35, the spindle head 5 is guided by the guide rails 32 through the nut and is moved to-and-fro in the Y-axis direction.

A pair of guide rails (for a Z-axis guideway) 26 are provided in parallel with each other in the Z-axis direction on the top surface of the bed 3. A table device 13 is disposed movably in the Z-axis direction on the two guide rails 26. The Z-axis guideway for guiding the table device 13 may be selected from a rolling guide, a plain bearing guideway, and the like.

When a Z-axis servomotor (not shown) is driven, the table device 13 is guided by the guide rails 26 through a ball screw (not shown) and is moved to-and-fro in the Z-axis direction.

The table device 13 has a table 13*a*. The table 13a is provided to be rotatable and indexical along a B-axis (direction round the Y-axis) to thereby rotate and index the workpiece 7 round the B-axis.

An index head 27 is provided to be rotatable and indexical along an A-axis (direction round horizontal axis perpendicular to the B-axis) on a top surface of the table 13*a*. The index head 27 detachably supports the workpiece 7 through a fixture 28 and may rotate and index the workpiece 7 round the A-axis.

Incidentally, the explanation has been given to the grinding machine 1 in which the movement in the X-axis direction is done by the movement of the column 4, the movement in the Y-axis direction is done by the movement of the spindle head 5 and the movement in the Z-axis direction is done by the movement of the table device 13. However, the applicable system is not limited thereto or thereby.

Namely, it is sufficient to use a grinding machine in which the grinding wheel 8 mounted on the main spindle is rotated and the workpiece 7 and the grinding wheel 8 may be moved relative to each other along at least three mutually transverse axes including a direction parallel with the main spindle axis to thereby grind the workpiece 7.

A tool magazine 15 receiving a single or a plurality of grinding wheels 8 is provided on a side of the bed 3. An automatic tool changer (hereinafter referred to as an ATC) 14 is provided on a body of the tool magazine 15.

The ATC 14 has a twin-arm type tool changing arm 16. The tool changing operation is performed between the main spindle 6 and the tool magazine 15 by the tool changing arm 16.

The tool changing arm 16 detachably grips the grinding wheels 8 with one gripping portion 17 and the other gripping portion 18, respectively. Then, the gripping portions 17 and 18 perform a swiveling operation round a swivel shaft (not shown) of the tool changing arm 16 and an advance and retract movement operation in an axial direction of the swivel shaft to thereby attain the changing operation of the grinding wheels 8 to the main spindle 6 and receiving receptacles of the tool magazine 15.

The grinding wheel 8, mounted on the main spindle 6 by the ATC 14, and the workpiece 7 on the table 13a are relatively moved along three mutually transverse axes (X, Y, Z) including a direction parallel with a center axis (hereinafter referred to as a main spindle axis) CL of the main spindle 6, and/or are rotated round the A-axis and B-axis. At the same time, the main spindle 6 is drivingly rotated, so that the workpiece 7 is ground by the rotating grinding wheel 8. An area for grinding is covered by a telescopic type cover 19 (see FIG. 3), a splash guard (not shown), and the like.

A coolant supply unit 22 is provided in the vicinity of a machine body of the grinding machine 1. The coolant supply unit 22 is provided with a reservoir for reserving the coolant, a pump for supplying the coolant La and Lb at a predetermined pressure and at a predetermined flow rate, and other equipments.

While the grinding machine 1 grinds, the coolant supply unit 22 supplies the coolant La having a predetermined pressure at a predetermined flow rate to a grinding point (i.e. grinding position) P1 at which the grinding wheel 8 grinds the workpiece 7, thereby simultaneously performing a cooling operation and a removing operation of grinding chips (grinding debris).

Also, the coolant supply unit 22 supplies the coolant Lb for cleaning to a periphery (grinding circumferential surface) of the grinding wheel 8 while the grinding machine 1 grinds, thereby removing the grinding chips which cause the loading chips on the periphery of the grinding wheel 8. The coolant Lb is supplied at a higher pressure and at a smaller flow rate than the predetermined pressure and the predetermined flow rate of the coolant La.

A nozzle supporting device 21 is mounted on the spindle head 5. The coolant La and Lb are supplied to predetermined positions by the nozzle supporting device 21 moving a cooling nozzle 37 and a cleaning nozzle 38 (see FIG. 3).

A continuous dressing device 10 of the grinding machine 1 will now be described.

The continuous dressing device 10 for continuously dressing the grinding wheel 8 during grinding is provided to be movable with the guidance of the guide rails 32. Namely, a dressing device body 11 of this continuous dressing device 10 is provided on the column 4 to be relatively movable to the spindle head 5 in the Y-axis direction and is provided separately away from the spindle head 5.

A dresser supporting member 45 is provided on the dressing device body 11 so as to be relatively movable to the dressing device body 11 in at least Y-axis direction perpendicular to the direction of the main spindle axis CL. At least one dresser (dressing tool) 12 rotatably supported to the dresser supporting member 45 is rotated to thereby dress the grinding wheel 8.

While the grinding machine 1 grinds with continuous dressing, an operation of dressing the grinding wheel 8 with the dresser 12 and an operation of grinding the workpiece 7 with the grinding wheel 8 are simultaneously performed. While the grinding machine 1 grinds with continuous dressing, the dressing device body 11 is moved to a dressing position at which the dresser 12 may dress the grinding wheel 8 in the vicinity of the spindle head 5. Thus, the workpiece 7 is ground by the grinding wheel 8 while the grinding wheel 8 is dressed by the dresser 12.

On the other hand, while the grinding machine 1 normally grinds except for the grinding with continuous dressing, the dressing device body 11 is positively largely separated away from the spindle head 5 and is moved to a retracted position in which the workpiece 7 and the continuous dressing device 10 do not interfere with each other. Thus, the grinding wheel 8 is moved in a circumference of the workpiece 7 as desired relative thereto, so that the grinding wheel 8 may grind the workpiece 7.

The dresser supporting member 45 which is movable to-and-fro with a dresser-axis servomotor 47 is provided on the dressing device body 11. A pair of guide rails (for a V-axis guideway) 44 are mounted in parallel on the dressing device body 11 in a V-axis direction parallel with the Y-axis direction. The dresser supporting member 45 is moved in the V-axis direction by the guidance of the two guide rails 44. The V-axis guideway for guiding the dresser supporting member 45 may be selected from a rolling guide, a plain bearing guideway, and the like.

A screw shaft 46 of a V-axis ball screw is provided in parallel with the guide rails 44 between the two guide rails 44. A nut (not shown) fixed to the dresser supporting member 45 is screwed on the screw shaft 46.

The screw shaft 46 is drivingly rotated in a forward direction or a backward direction by the dresser-axis servomotor 47 mounted on the dressing device body 11. When the screw shaft 46 is drivingly rotated by the dresser-axis servomotor 47, the dresser supporting member 45 is moved to-and-fro in the V-axis direction through the nut while the dresser supporting member 45 is guided by the guide rails 44.

Since the dresser supporting member 45 is driven by the dresser-axis servomotor 47 and is moved in the V-axis direction relative to the spindle head 5, it is possible to dress the grinding wheel 8 by moving the dresser 12 inch by inch at a predetermined dimension.

A motor 48 for drivingly rotating the dresser is incorporated in the dresser supporting member 45. The dresser 12 has a center axis CL1 in a direction parallel with the main spindle axis CL. In order to rotatably support the shaft portion of the dresser 12 to the dresser supporting member 45, both end portions of the dresser 12 are rotatably supported by bearing devices 49 and 50 incorporating therein bearings. The dresser 12 is drivingly rotated through pulleys 51 and 52 and a belt 53 by the dresser rotational driving motor 48.

A detected portion 41 is provided on the dressing device body 11. When a first sensor S1 mounted on the column 4 detects the detected portion 41, it is thereby detected that the dressing device body 11 is located in the retracted position.

In order to couple the spindle head 5 and the dressing device body 11 with each other, a coupling and releasing means 54 is provided. The coupling and releasing means 54 performs a coupling and releasing operation through a clamping and unclamping mechanism (not shown) by a clamping and unclamping cylinder device 59 mounted on the dressing device body 11.

The coupling and releasing means 54 has a function to couple the spindle head 5 and the dressing device body 11 with each other while the grinding machine 1 grinds with continuous dressing, and to release the coupling between the spindle head 5 and the dressing device body 11 while the grinding machine 1 normally grinds.

When the dressing device body 11 is maintained to be coupled by the coupling and releasing means 54, the dressing device body 11 is controlled to be moved in the Y-axis direction together with the spindle head 5. A set of coupling and releasing means 54 may be used, but preferably at least two sets of coupling and releasing means 54 may be provided on the head body portion 30 or on the head body portion 30 and the nose portion 31 to thereby take a balance of load and dispersion of the load during coupling.

A retainer means 55 has a cylinder device 56 mounted on the column 4. The retainer means 55 has a function to retain the dressing device body 11, to the column 4 at a predetermined retracted position, retracted largely away from the spindle head 5 while the grinding machine 1 normally grinds with the grinding wheel 8.

A piston rod 58 of the cylinder device 56 retains a retainer member 57 of the dressing device body 11, so that the dressing device body 11 is retained to the column 4 through the retainer means 55 in the above-described retracted position.

A detected portion 42 is mounted on the head body portion 30 of the spindle head 5. This detected portion 42 may be detected by second and third sensors S2 and S3 which are mounted on the column 4. The second sensor S2 detects the fact that the spindle head 5 has been moved to an upper limit position. The third sensor S3 detects the fact that the spindle head 5 has been moved to a lower limit position.

A direction for moving of the dressing device body 11 is a vertical direction. A counterbalance cylinder 40 is provided between the column 4 and the dressing device body 11 for maintaining a weight balance of the continuous dressing device 10. A piston rod 39 of this counterbalance cylinder 40 is coupled with the dressing device body 11.

Namely, the counterbalance cylinder 40 always draws the dressing device body 11 in a direction in which the dressing device body 11 is raised at a load which may maintain substantially balance with the weight of the continuous dressing device 10.

Thus, even if the spindle head 5 and the continuous dressing device 10 are coupled with each other in one piece, a movement control may be suitably carried out without imparting an extra load to the Y-axis servomotor 35.

A coolant supply apparatus 60 for supplying the coolant La and Lb, while the grinding machine 1 grinds, will next be described.

As shown in FIG. 1, FIGS. 3 to 6A and FIG. 6B, the nozzle supporting device 21 has a moving member 61 which is provided on the spindle head 5. At least one cooling nozzle 37 to be used as a first nozzle and at least one cleaning nozzle 38 to be used as a second nozzle are provided on the moving member 61.

The cooling nozzle 37 is a nozzle for injecting the coolant La at a predetermined pressure (for example, 40 kgf/cm$^2$, i.e., $3.9\times10^6$ Pa) and at a predetermined flow rate (for example, 0.25 m$^3$/min) to the grinding point P1 at which the grinding wheel 8 and the workpiece 7 are brought into contact for the grinding. Incidentally, the coolant La may be positively and sufficiently supplied to the grinding point P1 at the pressure and the flow rate at which a cooling of the vicinity of the grinding point P1 and a discharge of the grinding chips may be sufficiently performed.

The cleaning nozzle 38 is a nozzle which injects the coolant Lb to a periphery 8*a* of the grinding wheel 8 at a predetermined pressure and at a predetermined flow rate for cleaning. This cleaning prevents from loading the grinding chips on a grinding wheel circumferential surface as the periphery 8*a*.

In order to prevent the loading chips on the periphery of the grinding wheel, it is sufficient to supply the coolant Lb at a higher pressure than that of the coolant La and at a smaller flow rate than that of the coolant La.

Namely, the coolant Lb may have a pressure and a flow rate at which the material such as grinding chips adhered to the periphery of the grinding wheel may be blown out before the material may be next brought into contact with a surface, to be ground, of the workpiece.

The cooling nozzle 37 and the cleaning nozzle 38 are mounted on a single supporting member 62. The supporting member 62 is detachably mounted on the moving member 61.

A nozzle moving controller 69 includes a servomotor controlling section connected to an NC (numerical control) system. The nozzle moving controller 69 controls a movement of the moving member 61 in a direction substantially identical with a first normal line K2, to the grinding wheel 8, which is positioned at a first predetermined angle θ1 away from a reference straight line K1, perpendicular to the main spindle axis CL, passing through the grinding point P1.

The moving member 61 is movable in a direction parallel with the main spindle axis CL, as indicated by a double headed arrow E (see FIG. 3), by operating the nozzle supporting device 21. Also, the moving member 61 is movable in a plain perpendicular to the main spindle axis CL relative to the grinding wheel 8. Furthermore, the moving member 61 makes a motion for always maintaining the same posture along a predetermined plain including the main spindle axis CL. For this purpose, the nozzle supporting device 21 has a mechanism for moving the moving member 61 in a direction parallel with the main spindle axis CL. The nozzle supporting device 21 is provided with an arm swinging mechanism 63*a* and a parallel link mechanism 63*b*, as shown in FIGS. 4A and 4B.

A swiveling sleeve 64 is fitted around the nose portion 31 to be able to swivel round the main spindle 6 so as to center the main spindle axis CL. The nozzle supporting device 21 having the moving member 61 is mounted on the swiveling sleeve 64. The arm swinging mechanism 63*a* and the parallel link mechanism 63*b* are mounted on the swiveling sleeve 64.

A C-axis driving motor 65 is mounted on the head body portion 30. A driving torque of the C-axis driving motor 65 is transmitted to a sprocket 67 through a speed reducer 66 provided on an output side of the motor 65. A chain 68 is laid around the sprocket 67 and a sprocket (not shown), on the swiveling sleeve side, provided on an outer circumference of the swiveling sleeve 64.

Accordingly, when the C-axis driving motor 65 is driven, the swiveling sleeve 64 makes a swiveling motion round the C-axis which is concentric with the main spindle axis CL, through the speed reducer 66, the sprocket 67, the chain 68 and the sprocket of the swiveling sleeve side. Thus, the moving member 61 may be swivelled round the main spindle 6 so as to center the main spindle axis CL.

As shown in FIG. 4A, an α-axis motor 70 and a β-axis motor 71 are mounted on the swiveling sleeve 64. Speed reducers (not shown) are provided on output portions of the α-axis motor 70 and the β-axis motor 71, respectively.

Although a rotational center O1 of the α-axis motor 70 and a rotational center O2 of the β-axis motor 71 are concentric, FIG. 4A depicts as if a position of the rotational center O2 were shifted from the rotational center O1, in order to clarify the structure.

The arm swinging mechanism 63*a* is provided with a first arm 72, which is swung round the α-axis by the α-axis motor 70, and a second arm 73 which is swingably coupled with the first arm 72. The second arm 73 is swingable round a β-axis. The moving member 61 is swingably coupled with the second arm 73.

A transmission mechanism is composed of a link mechanism including a link 74, which is swung by the β-axis motor 71, a link 75 integrally fixed to the second arm 73 and a link 76 for coupling the links 74 and 75 with each other.

Accordingly, when the β-axis motor 71 is driven, the second arm 73 swings round the β-axis through the links 74, 76 and 75. Namely, the transmission mechanism having the links 74, 76 and 75 is provided for the purpose of transmitting the driving torque of the β-axis motor 71 to the second arm 73.

FIG. 4B is a view illustrating the parallel movement of the moving member 61 for always maintaining the same posture.

As shown in FIG. 4B, the first arm 72 and the second arm 73 have the parallel link mechanism 63*b*. The first arm 72 is swingable round a rotational center O3 which is concentric with the above-described rotational centers O1 and O2.

One end of a link 80 is coupled with the rotational center O3 and the other end of the link 80 is coupled with a supporting point H of the swiveling sleeve 64, respectively. A link 81 is parallel with the first arm 72 and is coupled with the link 80 at the supporting point H. A link 82 is parallel with the link 80 and is coupled with the first arm 72 and the link 81.

Accordingly, a first link mechanism for defining a parallelepiped shape is composed of the links 80, 81, 82 and the first arm 72. The rotational center O3 and the supporting point H are the fixed points on the swiveling sleeve 64. Accordingly, when the first arm 72 swings round the rotational center O3 (O1), the link 82 makes a parallel motion for always maintaining a parallel condition with the link 80.

The link 82 is coupled with the second arm 73. A link 83 is coupled with the link 82 and is parallel with the second arm 73. A link 84 is integrally fixed to the moving member 61. The link 84 is coupled with the second arm 73 and the link 83.

Thus, a second link mechanism for defining a parallelepiped shape is composed of the links 82, 83, 84 and the second arm 73. Accordingly, when the second arm 73 swings round the β-axis, the link 84 makes a parallel motion for always maintaining a parallel posture with the link 82.

In summing up these operations, even if the first and second arms 72 and 73 swing, the moving member 61 fixed to the link 84 makes the parallel motion for always maintaining the same posture along the predetermined plain including the main spindle axis CL. Incidentally, when the swiveling sleeve 64 is swivelling round the main spindle axis CL, the predetermined plain which serves as the reference is also changed.

The α-axis motor 70 and the β-axis motor 71 are drivingly controlled in accordance with commands of the nozzle moving controller 69. Thus, it is possible to move the moving member 61 along the above-described predetermined plain through the arm swinging mechanism 63*a* and the parallel link mechanism 63*b*. Namely, the moving member 61 is moved at will in a radial direction (radial direction of the main spindle 6) so as to center the main spindle axis CL, and in the direction (indicated by the arrow E in FIG. 3) parallel with the main spindle axis CL.

Also, as shown in FIGS. 3, 4A and 4B, the C-axis driving motor 65 is drivingly controlled in accordance with the commands of the nozzle moving controller 69. Thus, the nozzle supporting device 21 having the moving member 61 is swivelled at will within an angular range of 360° round the main spindle axis CL.

Accordingly, the cooling nozzle 37 and the cleaning nozzle 38 which are mounted on the moving member 61 may be moved at any desired position within a three dimensional space.

As shown in FIGS. 5, 6A and 6B, the cooling nozzle 37 and the cleaning nozzle 38 are mounted on the block-like supporting member 62. The supporting member 62 is detachably mounted on a mounting portion 61*b* provided on a tip end portion 61*a* of the moving member 61. The supporting member 62 may be clamped and unclamped relative to the moving member 61 by a clamping and unclamping mechanism 86.

In the clamping and unclamping mechanism 86, a hole portion 87 is formed in the moving member 61. A shaft portion 88 is mounted on the supporting member 62. An engagement groove 88*b* is formed in the shaft portion 88. A piston 88*c* is inserted into a first hole portion 61*c* and a second hole portion 61*d* of the moving member 61. A large diameter hole portion 88*d* and a small diameter hole portion 88*e* are formed in an inner diameter portion of the piston 88*c*.

Also, a single or a plurality of holes 61*f* are formed in an intermediate shaft portion 61*e* of the moving member 61. A plurality of ball-like engagement members 88*a* are received in the respective holes 61*f* to be movable in the radial directions. A first cylinder chamber 88*g* and a second chamber 88*h* are formed between the first hole portion 61*c* of the moving member 61 and the piston 88*c*. A compression spring 88*f* is assembled into the second chamber 88*h*. The compression spring 88*f* depresses the piston 88c forwardly.

Accordingly, when compressed air 89 is supplied into the first cylinder chamber 88*g*, the piston 88*c* is retracted rearwardly. Then, since the large diameter hole portion 88*d* is moved to a position of the engagement members 88*a*, the engagement members 88*a* may be moved in the radial directions. This condition is an unclamping condition shown in FIG. 6B, in which the supporting member 62 may be inserted and removed relative to the moving member 61.

Also, when the supply of the compressed air 89 is stopped, the piston 88*c* is moved forwardly by a force of the compression spring 88*f*. Thus, the radial movements of the engagement members 88*a* are restricted. Namely, the engagement members 88*a* maintain the engagement condition with the engagement groove 88*b* of the shaft portion 88 of the supporting member 62. This condition is a clamping condition shown in FIG. 6A, in which the supporting member 62 is clamped to the moving member 61.

Since the supporting member is detachable from the moving member 61, a supporting member 62*a* having a different structure from that of the supporting member 62 may be mounted on the moving member 61 so as to be changed. At least one cooling nozzle (first nozzle) 37*a* and at least one cleaning nozzle (second nozzle) 38*a* are mounted on the other supporting member 62*a* at counter positions to the mounted positions of the cooling nozzle 37 and the cleaning nozzle 38, respectively.

The changing between the supporting member 62 and the other supporting member 62*a* to the moving member 61 may be automatically performed by an automatic nozzle changer (not shown) provided in the grinding machine 1.

Steps for supplying the coolant in a good condition when the workpiece 7 is ground by the grinding wheel 8 will now be described.

As the grinding wheel 8 grinds the workpiece 7, the diameter of the grinding wheel 8 gradually becomes smaller by the wearing and the dressing of the grinding wheel 8, and the like. In FIG. 5, a profile of the grinding wheel 8 is gradually changed from a diameter D1 to a diameter D2. FIG. 5 shows a state in which the grinding wheel 8 is relatively moved in a direction of an arrow F to the workpiece 7 while the grinding wheel 8 rotates in a direction of an arrow J (clockwise direction in FIG. 5).

The nozzle supporting device 21 is controlled, so that the moving member 61 is moved in correspondence with the changing diameter of the grinding wheel 8 in a direction which is substantially identical with the first normal line K2 relative to the grinding wheel 8. The first normal line K2 is a predetermined normal line positioned at a first predetermined angle θ1 away from the reference straight line K1 connecting the grinding point P1 and the main spindle axis CL.

Thus, the cooling nozzle 37 and the cleaning nozzle 38 are moved, together with the supporting member 62 mounted on the moving member 61, in the direction which is substantially identical with the first normal line K2, as shown by an arrow M.

While the diameter of the grinding wheel 8 is changing, by the moving operation of the moving member 61, an injecting outlet port 34 of the cooling nozzle 37 injects the coolant La to the grinding point P1 while the outlet port 34 is always directed in a direction substantially identical with a tangential line K3, of the grinding wheel 8, passing through the grinding point P1. Also, while the diameter of the grinding wheel 8 is changing, an injecting outlet port 36 of the cleaning nozzle 38 injects the coolant Lb to the periphery 8*a* of the grinding wheel 8 while the outlet port 36 is always directed in a direction substantially identical with a normal line K4 (i.e., a normal line of the grinding wheel 8 in an injection point P2 on the periphery 8*a*) relative to the grinding wheel 8.

Thus, even if the diameter of the grinding wheel 8 is changed from the dimension D1 to the dimension D2, the coolant La is always injected to the grinding point P1 by the cooling nozzle 37, thereby cooling the vicinity of the grinding point P1 without failure and thereby making it possible to continuously and stably grind.

On the other hand, when the diameter of the grinding wheel 8 is changed, an injecting direction of the coolant Lb to be injected by the cleaning nozzle 38 is somewhat changed from one side to the other side relative to the normal line K4. However, almost all the energy possessed with the cleaning coolant Lb acts in the direction of the normal line K4. Accordingly, when a third angle γ defined between the injecting direction of the coolant Lb and the direction of the normal line K4 is within a range of about ±30 degrees, it is possible to sufficiently clean the grinding wheel 8.

In some cases, in order to perform another grinding relative to the workpiece 7, the grinding wheel 8 is rotated in the opposite direction (counterclockwise in FIG. 5) to the direction indicated by the arrow J, and the cooling nozzle 37*a* and the cleaning nozzle 38*a* mounted at the counter positions on the other supporting member 62*a* are used.

In this case, the nozzle supporting device 21 is controlled, so that the moving member 61 is operatively swivelled round the main spindle axis CL, as indicated by an arrow N. Thus, the moving member 61 is moved substantially to a position of a second normal line K5. The second normal line K5 relative to the grinding wheel 8 is opposite to the position of the first normal line K2 relative to the reference straight line K1 and is positioned at a second predetermined angle θ2 away from the reference straight line K1.

It is preferable that the first predetermined angle θ1 is about 30 degrees and that the second predetermined angle θ2 is about 40 degrees. Incidentally, since the first and second predetermined angles θ1 and θ2 are affected by the diameter of the grinding wheel 8, the profile of the workpiece 7, the condition of the grinding, the interference with other members, the workpiece 7, or the like, it is sufficient that the predetermined angles θ1 and θ2 are the desired angles selected from a range of 15 to 50 degrees.

Thereafter, the moving member 61 is moved in a direction which is substantially identical with the second normal line K5, as indicated by an arrow M1, in correspondence with the changing diameter of the grinding wheel 8. Thus, an injecting outlet port 34*a* of the cooling nozzle 37*a* of the counter position injects the coolant La to the grinding point P1 while the outlet port 34*a* is always directed in a direction substantially identical with a tangential line K6, of the grinding wheel 8, passing through the grinding point P1. Also, an injecting outlet port 36*a* of the cleaning nozzle 38*a* of the counter position injects the coolant Lb to the periphery 8*a* of the grinding wheel 8 while the outlet port 36*a* is always directed in a direction substantially identical with a normal line K7 relative to the grinding wheel 8.

The operation of the grinding machine 1 will now be described.

As shown in FIGS. 1 to 6A and FIG. 6B, it is assumed that the desired grinding wheel 8 is mounted on the main spindle 6 and the dressing device body 11 is retained to the column 4 in the retracted position by the retainer means 55, as a result of which the grinding wheels are changed between the tool magazine 15 and the main spindle 6 by the operation of the tool changing arm 16 of the ATC 14, and the like.

In the case in which the grinding machine 1 grinds with continuous dressing (that is, the dresser 12 continuously dresses the grinding wheel 8 during grinding), it is necessary to couple the spindle head 5 and the dressing device body 11 with each other.

For this reason, first of all, the Y-axis servomotor 35 is driven so that the spindle head 5 is raised up to the predetermined coupling position. Then, the coupling and releasing means 54 is operated, so that the spindle head 5 and the dressing device body 11 are coupled with each other. The retainer means 55 is also operated so as to release the piston rod 58 from the retainer member 57.

Subsequently, when the Y-axis servomotor 35 is drivingly controlled, the spindle head 5 and the dressing device body 11 are moved together in the Y-axis direction. When the dresser-axis servomotor 47 is driven, the dresser supporting member 45 is moved in the V-axis direction through the ball screw and the dresser 12 is brought into contact with or out of contact with the grinding wheel 8.

When the dresser 12 rotatively driven by the dresser rotational driving motor 48 is brought into contact with the grinding wheel 8, it is possible to dress the grinding wheel 8. Since the dresser 12 is supported at both ends by the dresser supporting member 45, the dresser 12 is never separated away from the grinding wheel 8 with a load during the dressing.

When the grinding with continuous dressing is continued, the diameter of the grinding wheel 8 is gradually decreased. Accordingly, in correspondence with this change of the diameter, when the dresser-axis servomotor 47 is driven and the dresser supporting member 45 is moved toward the spindle head 5, the dresser 12 continuously dresses the grinding wheel 8.

Thus, the spindle head 5 and the dressing device body 11 are integrally coupled with each other and are movingly controlled in the Y-axis direction, and the column 4 and the table 13*a* are movingly controlled in the X-axis direction and Z-axis direction, respectively. Furthermore, the workpiece 7 is rotated and indexed round the B-axis and the A-axis by the table 13a and the index head 27. The main spindle 6 is drivingly rotated. Thus, the workpiece 7 is ground by the grinding wheel 8 while the dresser 12 continuously dresses the grinding wheel 8.

An operation in the case, in which the operation is moved to the normal grinding after the above-described grinding with continuous dressing, will now be described.

In order to release the coupling between the spindle head 5 and the dressing device body 11 away from each other, first of all, the Y-axis servomotor 35 is drivingly controlled so that the spindle head 5 is moved upwardly to a predetermined coupling position in the Y-axis direction. The piston rod 58 of the cylinder device 56 of the retainer means 55 is retained to the engagement member 57.

Subsequently, the coupling and releasing means 54 is operated to thereby release the coupling between the dressing device body 11 and the spindle head 5. Thereafter, the spindle head 5 is moved by the Y-axis servomotor 35 down to a position for grinding.

Since the dressing device body 11 is moved to the upward retracted position to be positioned in place, it is possible to grind the workpiece 7 with the grinding wheel 8 while the grinding wheel 8 is relatively moved round the workpiece 7 as desired. Namely, it is possible to grind an entire circumference of the workpiece 7. The dressing device body 11 is retained to the column 4 by the retainer means 55 in the retracted condition. This ensures the safety property.

The coolant La and Lb are supplied from the coolant supply unit 22 by the coolant supply apparatus 60 while the grinding machine 1 grinds with continuous dressing and normally grinds.

In order to move the moving member 61 and the supporting member 62 on which the cooling nozzle 37 and the cleaning nozzle 38 are mounted, the C-axis driving motor 65, the α-axis motor 70 and the β-axis motor 71 are drivingly controlled in accordance with the commands of the nozzle movement controlling device 69.

Thus, it is possible to move the moving member 61 in the direction which is substantially identical with the first normal line K2 in correspondence with the changing diameter of the grinding wheel 8. As a result, since the injecting outlet port 34 of the cooling nozzle 37 injects the coolant La to the grinding point P1 while the outlet port 34 is always directed substantially in the tangential line K3, of the grinding wheel 8, passing through the grinding point P1, it is possible to prevent the heat generation while the grinding wheel 8 grinds the workpiece 7. Also, it is possible to smoothly discharge the grinding chips and grinding debris.

Also, the moving member 61 is moved in the direction which is substantially identical with the first normal line K2, so that the injecting outlet port 36 of the cleaning nozzle 38 injects the coolant Lb to the periphery 8*a* of the grinding wheel 8 while the outlet port 36 is always directed substantially in the normal line K4 of the grinding wheel 8.

Thus, the small amount of grinding chips, grinding debris, and the like, which are generated during grinding and are stuck on the periphery 8*a* of the grinding wheel 8 may be brown away to prevent the loading chips. Namely, the cutting performance of the grinding wheel may be favorably maintained for a long period of time.

Incidentally, in the first embodiment, the case in which the coolant supply apparatus 60 is provided has been explained on the basis of an example of the grinding machine 1 which may grind with continuous dressing. However, in the present invention, it is possible to use a grinding machine which only may normally grind except for the grinding with continuous dressing.

Second Embodiment

Figure 7:
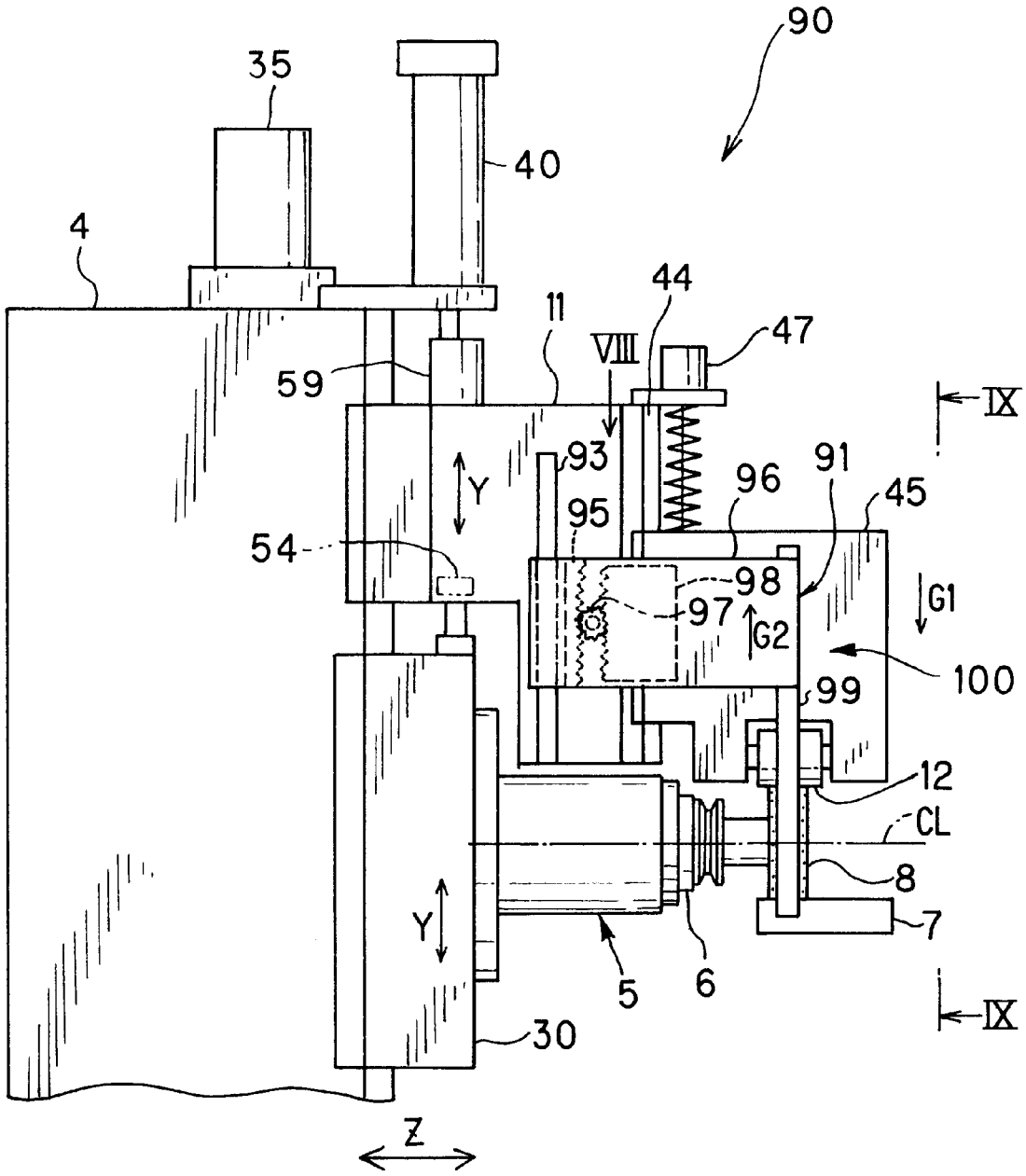
FIGS. 7 to 9 show a second embodiment of the present invention.
Figure 8:
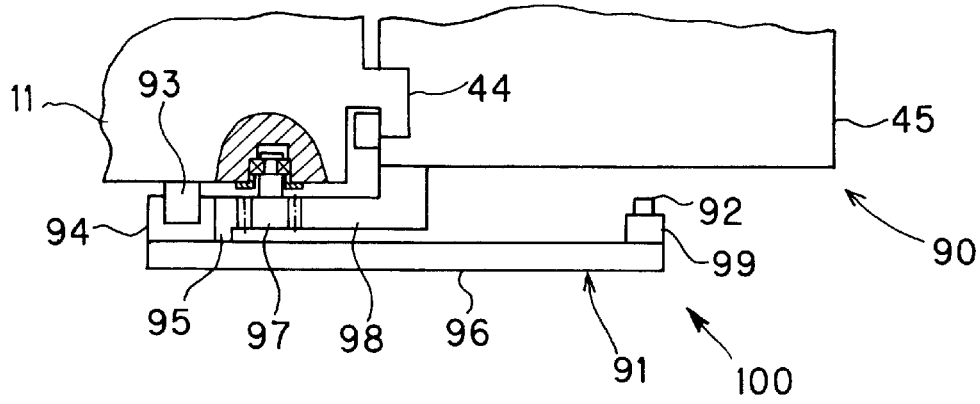
Figure 9:
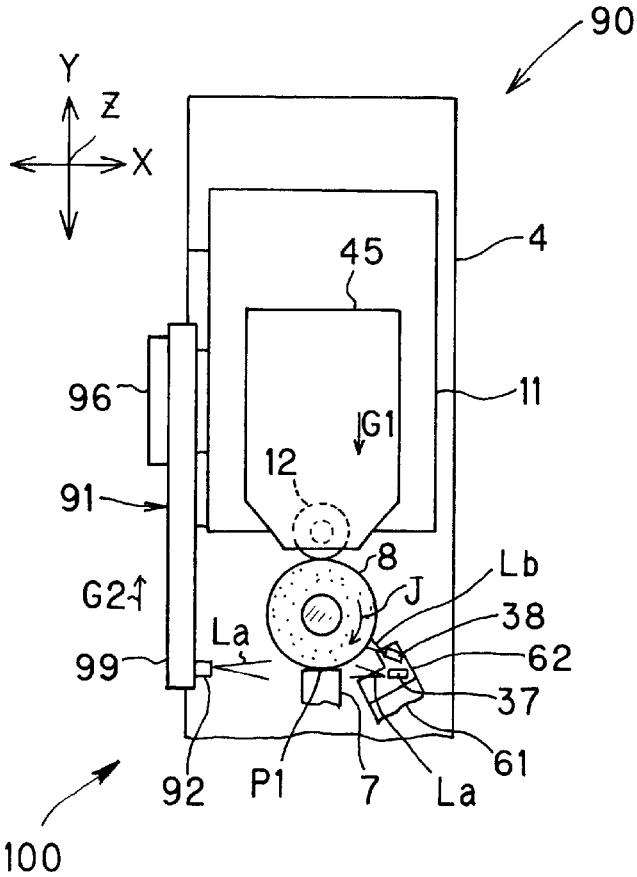

FIGS. 7 to 9 are views showing a second embodiment of the present invention. FIG. 7 is a left side view showing a schematic structure of a grinding machine 90 having a coolant supply apparatus 100. FIG. 8 is an enlarged view as viewed in a direction VIII of FIG. 7 and is a partial view showing a cross section. FIG. 9 is a view as viewed in a direction IX—IX of FIG. 7.

In the coolant supply apparatus 100 of the grinding machine 90 shown in FIGS. 7 to 9, a moving unit 91 and a mechanism for moving the moving unit 91 are added to the grinding machine according to the first embodiment, and the coolant La and Lb are supplied while the grinding machine 90 grinds.

Incidentally, the same reference numerals are used to indicate the same or like portions or components as those of the first embodiment, and the explanation therefor will be omitted. Only the explanation concerning different portions and components will be given.

In the grinding machine 90 according to the second embodiment, it is also assumed that the grinding wheel 8 is rotated in the direction indicated by the arrow J. The moving member 61, the supporting member 62, the cooling nozzle 37 and the cleaning nozzle 38 are disposed in the same manner as in the first embodiment on one side relative to the grinding point P1. The moving unit 91 is provided on the other side to be movable relative to the grinding point P1.

The injecting outlet port of the cooling nozzle 37 injects the coolant La to the grinding point P1 to cool down it while the outlet port is always directed in the direction substantially identical with the tangential line, of the grinding wheel 8, passing through the grinding point P1. The injecting outlet port of the cleaning nozzle 38 injects the coolant Lb to the periphery of the grinding wheel 8 while the outlet port is always directed in the direction substantially identical with the normal line of the grinding wheel 8. Incidentally, while the grinding machine 90 grinds with continuous dressing, it is possible to dispense with the cleaning nozzle 38.

At least one auxiliary cooling nozzle 92 is provided on the moving unit 91 and is disposed in a position facing the cooling nozzle 37. The moving unit 91 moves in an opposite direction (indicated by an arrow G2) to a moving direction (indicated by an arrow G1) of the dresser supporting member 45, and moves with the same moving amount as that of the dresser supporting member 45.

The auxiliary cooling nozzle 92 is a nozzle for cooling the grinding point P1 with an assistance. For this reason, an injecting outlet port of the auxiliary cooling nozzle 92 injects the coolant La to the grinding point P1 substantially in an opposite direction to the cooling nozzle 37 while the outlet port is always directed in a direction substantially identical with the tangential line, of the grinding wheel 8, passing through the grinding point P1.

A guide rail 93 is mounted on the dressing device body 11. At least one slide block 94 is engaged with the guide rail 93 to be movable up and down. The slide block 94 and a first rack 95 are fixed to a planar mounting member 96.

A pinion 97 is rotatably mounted on the dressing device body 11. A second rack 98 is fixed to the dresser supporting member 45. The first rack 95 and the second rack 98 are disposed in parallel with each other to sandwich the pinion 97. Accordingly, the first rack 95 is moved in an opposite direction to the moving direction of the second rack 98, and is moved with the same moving amount as that of the second rack 98.

A nozzle supporting member 99 is mounted on the mounting member 96 to be directed in the up-and-down direction (V-axis direction). The auxiliary cooling nozzle 92 is detachably mounted on a lower end portion of the nozzle supporting member 99.

The moving unit 91 for moving the auxiliary cooling nozzle 92 up and down is constituted of the mounting member 96, the slide block 94, the first rack 95 and the nozzle supporting member 99.

In this embodiment, the auxiliary cooling nozzle 92 is moved in the opposite direction to the moving direction of the dresser supporting member 45, and is moved with the same moving amount as that of the dresser supporting member 45. Thus, even if the diameter of the grinding wheel 8 is gradually decreased, the injecting outlet port of the auxiliary cooling nozzle 92 is always directed substantially in the direction of the tangential line, of the grinding wheel 8, passing through the grinding point P1. Then, the coolant La may always be injected to the grinding point P1 by the auxiliary cooling nozzle 92.

Thus, it is possible to inject the coolant La with the cooling nozzle 37 to the grinding point P1 in a rotational direction (indicated by the arrow J) of the grinding wheel 8 and at the same time to inject the coolant La to the grinding point P1 with the auxiliary cooling nozzle 92 substantially in the opposite direction to the injecting direction of the cooling nozzle 37.

As a result, it is possible to effectively prevent the heat generation in the vicinity of the grinding point P1 while the grinding wheel 8 grinds the workpiece 7. For example, it is possible to favorably perform the grinding in which the heat generation is remarkable such as a creep feed grinding. Also, the grinding chips may be smoothly discharged. Incidentally, it is possible to apply the idea of the second embodiment to the case in which the grinding wheel 8 is rotated in an opposite direction to the arrow J.

As described in the first and second embodiments, when the workpiece 7 and the grinding wheel 8 are moved relative to each other in a three dimensional space so as to grind the workpiece 7, the grinding point P1 is changing in the three dimensional space. The diameter of the grinding wheel 8 is gradually decreased by the grinding, and the length of the grinding wheel 8 in the axial direction is various. Accordingly, the grinding point P1 is also changing in the three dimensional space.

In such a case, since a movable range of the moving member 61 is large according to the present invention, it is possible to always inject the coolants La and Lb to the grinding point P1 and the periphery 8*a*, respectively, at desired positions in the three dimensional space.

Also, when the cooling nozzle 37*a* and the cleaning nozzle 38*a* which are located in the counter positions to the cooling nozzle 37 and the cleaning nozzle 38 are used, it is possible to always inject the coolant La to the grinding point P1 from the other direction without failure and also to clean the periphery 8*a* with the coolant Lb.

According to the present invention, the heat generated at the grinding point P1 is sufficiently cooled down by the coolant La, and the periphery 8*a* of the grinding wheel 8 is cleaned by the coolant Lb so that the loading chips on the grinding wheel 8 may be prevented. Accordingly, it is always possible to stably grind. It is possible to enhance the grinding efficiency (i.e., removal rate of the grinding chips) at least several tens of times (for example, hundred times or more) larger than that of the prior art. Also, it is possible to prolong the tool life of the grinding wheel. In particular, the present invention is effective in the case of the creep feed grinding.

Incidentally, the same reference numerals are used to indicate the like parts or the same parts throughout the drawings.

Various details of the invention may be changed without departing from its scope. Furthermore, the foregoing description of the embodiments according to the present invention is provided for the purpose of illustration only, and not for the purpose of limiting the invention as defined by the appended claims and their equivalents.

What is claimed is:

1. A method for supplying coolant in a grinding machine, while said grinding machine grinds, which grinds a workpiece by rotating a grinding wheel mounted on a main spindle and by relatively moving the workpiece and the grinding wheel along at least three mutually transverse axes including a direction parallel with an axis of the main spindle, said method comprising the following steps of:

mounting on a moving member at least one first nozzle, for cooling a grinding point at which the grinding wheel grinds the workpiece, and at least one second nozzle for cleaning a periphery of the grinding wheel; and moving said moving member in a direction substantially identical with a first normal line, relative to the grinding wheel, which is positioned at a first predetermined angle away from a reference straight line passing through the grinding point and being perpendicular to the axis of the main spindle, whereby said first nozzle injects said coolant with an injecting outlet port directed in a direction substantially identical with a tangential line, of the grinding wheel, passing through the grinding point, and said second nozzle injects said coolant with an injecting outlet port directed toward a point on the surface of the grinding wheel and in a direction within±30 degrees of the radial line from the axis of the grinding wheel through said point on the surface of the grinding wheel.

2. The method for supplying coolant in a grinding machine according to claim 1, wherein said moving member is movable in correspondence with a change of a diameter of the grinding wheel, and while the diameter of the grinding wheel is changing, said injecting outlet port of said first nozzle is always directed in the direction substantially identical with the tangential line, of the grinding wheel, passing through the grinding point, and said injecting outlet port of said second nozzle is always directed in the direction substantially identical with the normal line relative to the grinding wheel.

3. The method for supplying coolant in a grinding machine according to claim 1, wherein said moving member is movable in a direction parallel with the axis of the main spindle.

4. The method for supplying coolant in a grinding machine according to claim 1, wherein said moving member swivels round the axis of the main spindle.

5. The method for supplying coolant in a grinding machine according to claim 1, wherein said first nozzle and said second nozzle are mounted on a single supporting member which is detachably mounted on said moving member.

6. The method for supplying coolant in a grinding machine according to claim 5, wherein said supporting member is possible to be changed for another supporting member, at least one first nozzle and at least one second nozzle are respectively mounted on said last-mentioned other supporting member at counter positions to the mounting positions of said first nozzle and said second nozzle on said first-mentioned supporting member, and said other supporting member is detachably mounted on said moving member.

7. The method for supplying coolant in a grinding machine according to claim 6, wherein, said moving member is structured such that when said moving member is operatively swivelled round the axis of the main spindle so that said moving member is moved to a position of a second normal line, relative to the grinding wheel, which is opposite to the position of the first normal line relative to the reference straight line and is positioned at a second predetermined angle away from the reference straight line, said moving member is moved in a direction substantially identical with the second normal line, whereby said first nozzle in the counter position injects said coolant with an injecting outlet port directed in a direction substantially identical with a tangential line, of the grinding wheel, passing through the grinding point, and said second nozzle in the counter position injects said coolant with an injecting outlet port directed in a direction substantially identical with a normal line relative to the grinding wheel.

8. The method for supplying coolant in a grinding machine according to claim 1, wherein said first predetermined angle is selected from a range of 15 to 50 degrees.

9. The method for supplying coolant in a grinding machine according to claim 1, wherein said coolant having a predetermined pressure at a predetermined flow rate is supplied to said first nozzle for cooling the grinding point, and said coolant having a higher pressure than the predetermined pressure is supplied for cleaning to said second nozzle at a smaller flow rate than the predetermined flow rate.

10. The method for supplying coolant in a grinding machine according to claim 1, wherein said moving member makes a motion for always maintaining the same posture along a predetermined plane including the axis of the main spindle.

11. The method for supplying coolant in a grinding machine according to claim 1, wherein said grinding machine comprises a dresser supporting member which rotatably supports at least one dresser for dressing the grinding wheel, the dresser supporting member is relatively movable to the main spindle in at least one direction perpendicular to the axis of the main spindle, wherein said grinding machine is able to grind with continuous dressing in which an operation of dressing the grinding wheel with the dresser and an operation of grinding the workpiece with the grinding wheel are simultaneously performed, wherein said coolant is injected in the direction substantially identical with the tangential line while said grinding machine grinds with continuous dressing, and said coolant is injected in the direction substantially identical with the normal line while said grinding machine grinds with continuous dressing.

12. A method for supplying coolant in a grinding machine, while said grinding machine grinds, which grinds a workpiece by rotating a grinding wheel mounted on a main spindle and by relatively moving the workpiece and the grinding wheel along at least three mutually transverse axes including a direction parallel with an axis of the main spindle, a dresser supporting member for rotatably supporting at least one dresser for dressing the grinding wheel being moved relative to the main spindle in at least one direction perpendicular to the axis of the main spindle, said method comprising the following steps of:

injecting, through at least one cooling nozzle for cooling a grinding point at which the grinding wheel grinds the workpiece, said coolant with an injecting outlet port always directed in a direction substantially identical with a tangential line, of the grinding wheel, passing through the grinding point;

providing at least one auxiliary cooling nozzle for cooling the grinding point with an assistance on a moving unit, which moves in an opposite direction to a moving direction of the dresser supporting member and moves with the same moving amount as that of the dresser supporting member, wherein said auxiliary cooling nozzle is located at a position facing said cooling nozzle; and directing an injecting outlet port of said auxiliary cooling nozzle always in a direction substantially identical with the tangential line, of the grinding wheel, passing through the grinding point, and injecting said coolant to the grinding point from a substantially opposite direction to said cooling nozzle.

* * * * *